United States Patent [19]

Champagne

[11] Patent Number: 4,854,101

[45] Date of Patent: Aug. 8, 1989

[54] MOUNTING CLIP FOR INSTALLING SIDING

[76] Inventor: Wendel J. Champagne, 21823 W. Champagne Cir., Tomball, Tex. 77375

[21] Appl. No.: 54,519

[22] Filed: May 27, 1987

[51] Int. Cl.[4] ..... E04D 1/00; E04D 1/34

[52] U.S. Cl. ..... 52/520; 52/545

[58] Field of Search ..... 52/520, 543–545

[56] References Cited

U.S. PATENT DOCUMENTS

| | | | |
|---|---|---|---|
| 3,438,168 | 4/1969 | Tischuk | 52/520 X |
| 3,757,483 | 9/1973 | Torbett | 52/545 X |
| 3,999,348 | 12/1976 | Hicks | 52/544 |
| 4,348,849 | 9/1982 | Wollam et al. | 52/545 |
| 4,646,501 | 3/1987 | Champagne et al. | 52/545 X |

FOREIGN PATENT DOCUMENTS

| | | | |
|---|---|---|---|
| 817238 | 7/1959 | United Kingdom | 52/520 |

*Primary Examiner*—J. Karl Bell

*Attorney, Agent, or Firm*—Russell J. Egan

[57] ABSTRACT

A clip is crimped onto the upper edge of a metal or plastics material wall panel to retain the crimp form against relaxing over an extended time period. The clip engages a trim strip shoulder to prevent removal in a direction normal to the elongated axes of the panel and trim strip.

5 Claims, 1 Drawing Sheet

MOUNTING CLIP FOR INSTALLING SIDING

BACKGROUND OF THE INVENTION

1. Field of the Invention

The present invention relates to a clip for mounting sliding and in particular to a clip that provides improved holding engagement between a siding panel and a trim strip.

2. Description of the Prior Art

The current popular building materials for cladding both commercial and domestic buildings includes siding panels made of metal, such as aluminum, and plastics, such as vinyl. These panels are preformed with profiles simulating at least two rows of clapboard with each panel having top and bottom edges profiled for iterlocking with adjacent panels. The panels also have surfaces which may be textured and coated with an almost permanent color finish. The panels are usually started on the building with a starter strip or bracket, such as the one shown in my U.S. Pat. No. 4,646,501, the disclosure of which is hereby incorporated by reference. The top edge of the panel is secured to the building by inserting it into a trim strip which is an elongated preformed member of the same material as the siding panels and which defines a groove recieving the edge of the panel.

This type of mounting preserves the integrity of the panel, but is not sufficiently secure for all mounting situations. The normal method of improving the security of the mounting is to emboss the edge of the panel with a plurality of spaced apart crimps. These crimps can then be used to grip into the groove of the trim strip to hold the panel in place. An example of this can be found in U.S. Patent No. 3,757,483. While this provides an initial improvement in securing the panel, it is not a permanent fix in that the materials of the panel can relax of flow with time tending to resume their original shape. Thus an initially tight grip between a panel and the trim may, with time, become sufficiently loose that the panel could be removed by certain weather conditions. U.S. Pat. Nos. 1,941,216 and 3,512,222 discloses clips that can be used for joining panels together. However, these clips do not serve to hold the edge of a panel in a trim strip.

It would seem that a viable alternative would be to simply nail the top of the panel into the trim strip by driving nails through both the trim and panel. This would undoubtedly secure the members together, but it would also void manufactures warantees on the panels by adversely disrupting their surface finishes.

SUMMARY OF THE INVENTION

The present invention comprises a formed clip which is slipped over the upper edge of a siding panel and secured thereto by crimping. The clip then serves a twofold purpose, namely as a means to prevent the crimp from diminishing in size and shape to form a profile for gripping the trim strip. The subject clip is preferably stamped and formed from standard stock sheet metal material, such as aluminum.

BRIEF DESCRIPTION OF THE DRAWINGS

The present invention will now be described by way of example with reference to the accompanying drawings, in which.

DETAILED DESCRIPTION OF THE PRESENT INVENTION

Figure 1:
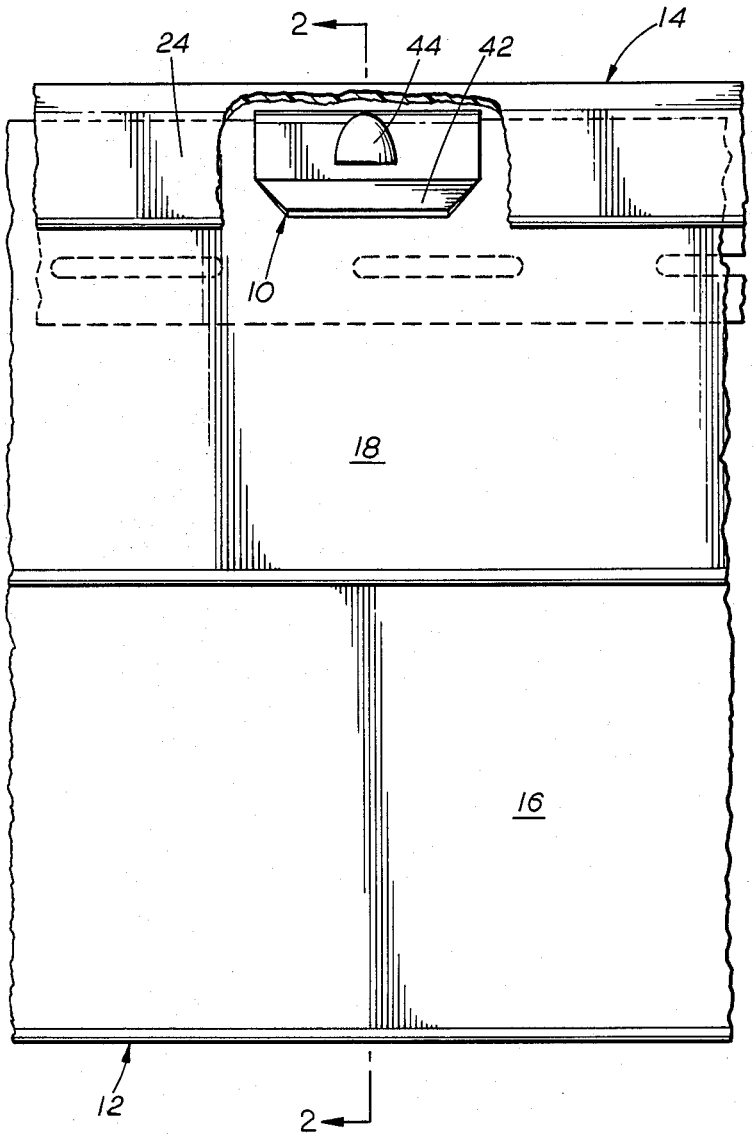
FIG. 1 is a side elevation, partly in section, showing a segment of a panel provided with the subject clip and mounted in a like segment of a trim strip.

The subject siding panelling mounting clip 10 is used to secure the top edge of a siding panel 12 in a trim strip 14.

The siding panel 12 is a standard panel formed from metal, such as aluminum, or plastics material, such as vinyl, into elongated members each having a profile simulating at least two rows of overlapping strips of traditional clapboard siding or shingles. The panel can be provided with surface texturing (not shown) and colorization (also not shown) to simulate a wide variety of different traditional buildlng materials. The typical panel has a profile of two overlapping clapboard members 16,18 with lower and upper profiled gripping edges 20,22. There often are instances when the upper edge 22 of the panel must be trimmed off, as shown, to the terminal profile of the building wall prior to the panel being inserted into the trim strip 14.

The trim strip 14 is an elongated member formed from the same material as the panel 12. The strip has a first portion 24 overturned to overly a second portion 26 and define a panel recieving groove 28 therebetween. The free edge of first portion 24 is turned inwardly toward second portion 26 to form a retention lip or shoulder 30. A nailing extension 32 depends from the second portion 26 and is provided with a plurality of preformed elongated apertures 34 for recieving mounting nails 36.

The subject clip 10 is stamped and formed from metal stock, such as aluminum, and has a first portion 38, a second portion 40 connected to and overturned to overly the first portion, and a third portion 42 extending outwardly from the free edge of the second portion 40 at an angle to the plane thereof and away from the first portion 38.

Figure 2:
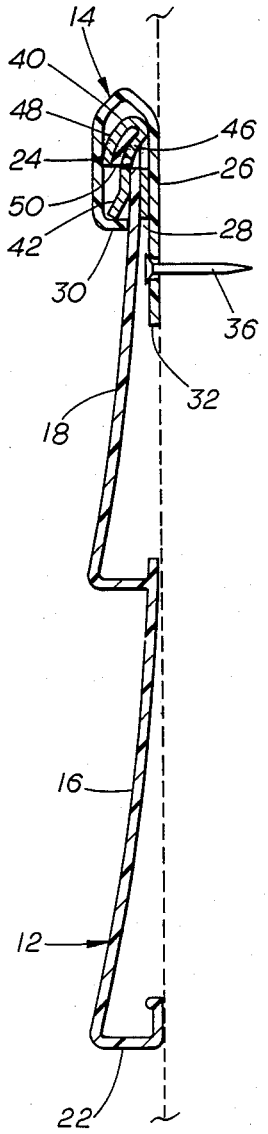
FIG. 2 is a section taken along line 2—2 of FIG. 1.
Figure 3:
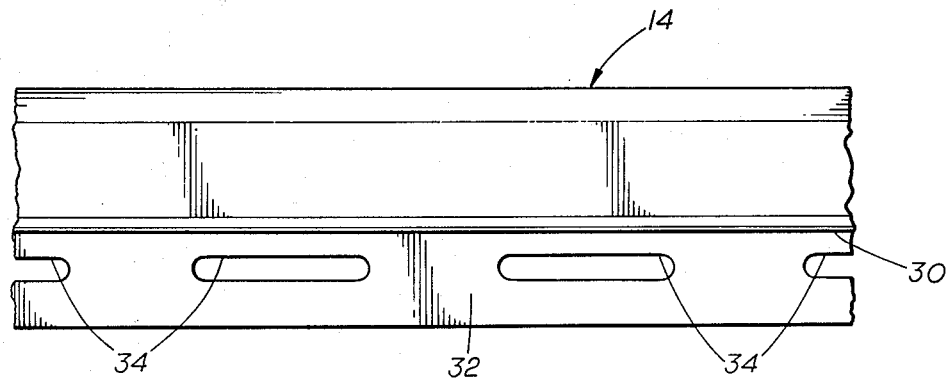
FIG. 3 is a side elevation of a segment of trim strip used in connection with the present invention.

The subject clip 10 is joined to the panel by slipping the clip 10 over the upper free edge 22 of the panel 12 and then crimping the two together. The crimp 44 displaces portion 46,48 of the clip 10 and 50 of the panel 12 in sandwich fashion, as best shown in FIG. 2. The metal of the clip has sufficient strength to hold the size and shape of the crimp 44 preventing it from relaxing and returning to its original form with time.

The panel 12, with a plurality of clips 10 crimped spaced along the upper edge 22, is mounted in the trim strip 14 by engaging the lower edge 20 of the panel with the upper edge of the next lower panel (not shown) in conventional fashion and then inserting the upper edge 22 into the groove 28 of the trim strip 14, the latter having been previously nailed into position by nails 36. The third portion 42 of the clip 10 engages the shoulder or lip 30 of the trim strip 14, as shown in FIG. 2, in such fashion as to resist disengagement in a direction normal to the elongated axes of the panel and trim strip. They can only be separated by the application of great force or by prying the trim strip open sufficiently to release the clip portions 42 from the trim strip shoulders 30.

While the present invention has been shown and described as it would be used at the top of a wall being panelled, it could likewise find other uses where the top edge of a building panel must be fixed into a trim strip, such as when there is a change in the paneling covering the wall or beneath windows or the like forming breaks in the wall.

As a specific example, the subject clip can be formed from 0.014 to 0.202 gauge 3003H14 aluminum, 0.018 being the preferred thickness. The clip would be approximately 1.5" long with the first and second portions being approximately 0.5" long and the third portion approximately ⅛" long bent to an angle of approximately 30.

The foregoing disclosure and description of the invention are illustrative and explanatory thereof, and various changes in the me6thod steps as well as in the details of the illustrated apparatus may be made within the scope of the appended claims without departing from the spirit or essential characteristics of the invention.

I claim:

1. In combination with siding panels and a trim strip, said panels being elongated profiled members of metallic or plastics material, said trim strip being an elongated member of like material defining a panel edge receiving cavity and being fixedly attached to a building structure, a clip formed from metal and profiled to a channel shape to be received on edge portion of said panel with first and second portions of said clip lying to either side of said panel, an edge portion of said first portion of said clip projecting outwardly to grippingly engage said trim strip, a crimp deforming both said first and second portions of said clip and a portion of the panel lying therebetween in sandwich fashion, said clip maintaining said crimp against relaxation by the material of said panel.

2. A method for positively mounting siding panels on a building or the like in such fashion s to assure retention in place, said method comprising the steps of:

fixing a trim strip along the intended terminal edge of the panelling, said strip having an overlying profile defining a panel edge receiving groove;

trimming the edge of the panel as necessary to conform to the desired terminal edge profile:

placing a series of clips spaced along the terminal edge of the panel, each clip having an overlying profile defining a panel receiving groove and trim strip gripping portion;

crimping each said clip to from an intimate connection between the clip and panel; and inserting the terminal edge of the panel with the clips into the groove of the trim strip to be fixed therein.

3. A clip for mounting edge portions of building panels in a sill trim strip having a panel edge receiving cavity, said clip comprising:

a metallic member having joined first and second portions formed into a channel shape to be received over an edge of a siding panel, at least one of said first and second portions having an outwardly projecting edge adapted to grippingly engage said trim strip, whereby a crimp placed in said clip deforms both portions and the panel therebetween with the clip maintaining the crimp shape against relaxation by the panel material.

4. The clip according to claim 3 wherein said clip is made of 0.014 to 0.020 gauge 3003H14 aluminum.

5. The clip according to claim 3 wherein said clip is approximately 1.5" long and each said portion is approximately 0.5" long.

* * * * *